United States Patent [19]

Lowry

[11] 3,989,156

[45] Nov. 2, 1976

[54] PALLET CONTAINER

[76] Inventor: William J. Lowry, 7208 Ridgeland, Sylvania, Ohio 43560

[22] Filed: Aug. 29, 1974

[21] Appl. No.: 501,621

[52] U.S. Cl. ..... 220/4 F; 217/12 R; 217/65; 312/263; 206/386

[51] Int. Cl.[2] ..... B65D 7/00; B65D 9/12; B65D 9/34

[58] Field of Search ..... 220/4 R, 4 F, 1.5, 75, 220/77, 85; 312/263, 264; 217/12 R, 43 R, 65; 206/386

[56] References Cited

UNITED STATES PATENTS

| | | | |
|---|---|---|---|
| 1,954,242 | 4/1934 | Heppenstall | 312/263 X |
| 2,960,249 | 11/1960 | Walsh | 220/4 F X |
| 3,589,547 | 6/1971 | Hambleton | 220/1.5 R |
| 3,674,328 | 7/1972 | White et al. | 312/263 |
| 3,831,799 | 8/1974 | Nutt | 220/4 F |

*Primary Examiner*—William Price
*Assistant Examiner*—Steven M. Pollard

[57] ABSTRACT

This invention is concerned with a four-sided pallet container which is used in connection with a bottom section. The pallet container of this invention is particularly suited for use in connection with produce and as a bulk industrial container. The pallet container utilizes a pair of opposing primary panels and a pair of opposing secondary panels. The primary and secondary panels are locked into position by opposing tapers. When positioned in a rectangular or square locking relationship, the primary and secondary panels are rigidly secured in a rectangular or square relationship when pressure is supplied to the underside of said primary panels. The pallet container of this invention can utilize a plurality of bottom sections. After assembly the pallet container of this invention can be readily broken down or disassembled. In disassembly, as a result of the integral, opposing locking taper means the secondary panel can be removed from the primary panel when the secondary panel is lifted approximately one half of the height of the primary panel. The component parts of the pallet container of this invention may be readily formed from polymeric materials.

14 Claims, 33 Drawing Figures

FIG. 3
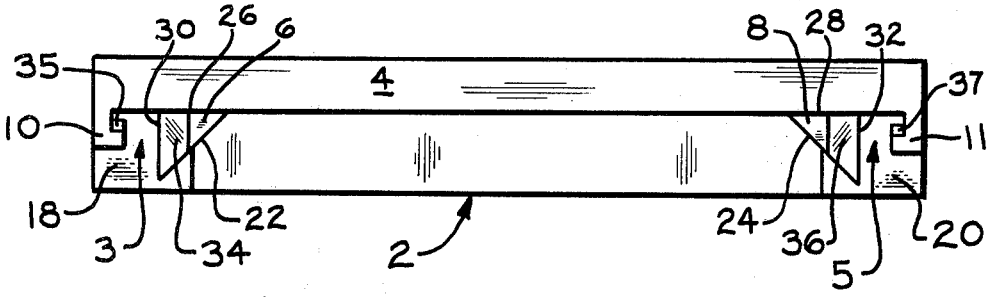
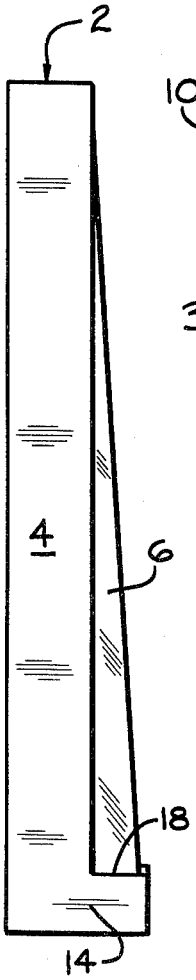
FIG. 2
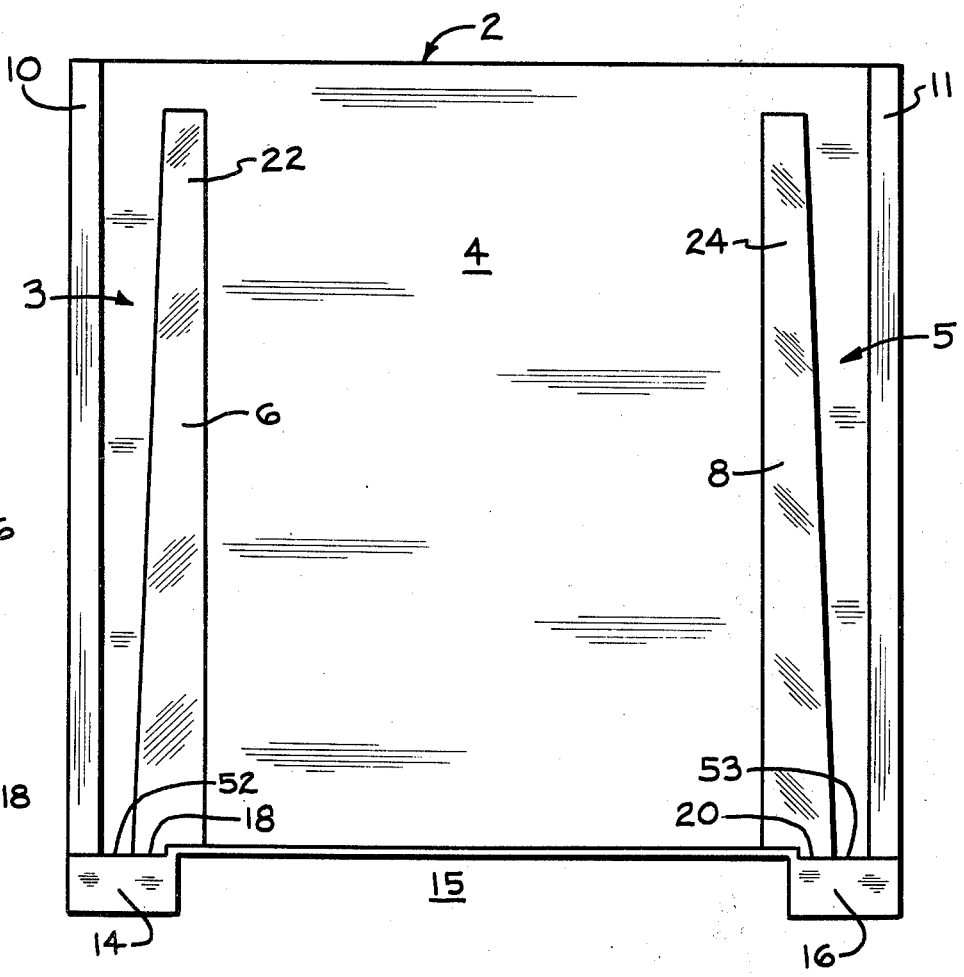
FIG. 1

PALLET CONTAINER

PRIOR ART

Pallet containers which generally comprise a base with four sides attached thereto in a square or rectangular form are commonly known in the prior art. In the most typical prior art embodiment, these component parts are formed from wood and are rigidly secured together by permanent fasteners, such as nails, bolts or staples. Containers of this type are widely used in agriculture as a means of containing produce for example orange boxes and apple boxes. Wooden prior art containers are becoming difficult to obtain due to the scarcity of wood. Likewise, because of the varying nature of wood the component parts of these prior art containers are not readily adapted to mass production techniques. Further, these prior art containers are undesirable in that as a result of their porous nature they tend to retain dirt and bacteria and they cannot be readily sterilized. Knockdown or demountable shipping containers are known in the prior art for example see the containers of U.S. Pats. Nos. 3,540,613, 3,589,547 and 3,589,548. The containers of these patents may be disassembled or demounted only with relative difficulty. Further, the component parts of these containers and the general prior art are not biased into a strengthened position when a lifting force is applied to the composite structure.

It is therefore an object of this invention to provide a pallet container which may be conveniently assembled and disassembled.

It is another object of this invention to provide a pallet container wherein the structural integrity of the composite container is improved when a lifting force is applied to the bottom of said pallet container.

It is still another object of this invention to provide a pallet container wherein the component parts are adapted to mass production from polymeric materials.

It is also the object of this invention to provide an improved pallet container.

These and other objects of the invention will become apparent from the following description when taken in conjunction with the drawings wherein:

FIG. 1 is a front view of the primary panel for use in this invention.

FIG. 2 is an end view of the primary panel for use in this invention.

FIG. 3 is a top view of the primary panel for use in this invention.

DESCRIPTION OF THE PREFERRED EMBODIMENT

Figure 7:
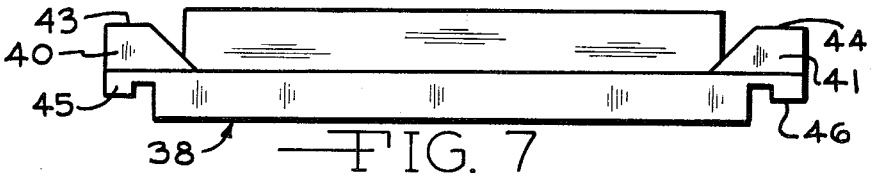
FIG. 7 is a top view of the secondary panel for use in this invention.

The subject invention is concerned with a four sided pallet container which is formed from a pair of primary panels and a pair of secondary panels, both sets of panels being joined together to produce a square or retangular container. A bottom section which can assume a plurality of forms is placed in the bottom of said square or retangular container to produce a pallet container.

For purpose of this invention a primary panel is defined as a panel which contains a female receiving portion such as a slot or an aperture. In contrast a secondary panel is defined as a panel which contains a male projection which is adapted to being received into a complimentary female slot or aperture which is an integral part of the primary panel. In both cases the male and female portions contain at least two tapers which are largest at their upper extremities and are angularly disposed to each other so as to produce opposing locking forces.

It is understood by one skilled in the art that these tapers can be disposed at any convenient angle and any convenient number of tapers can be utilized. In the preferred aspects of this invention two tapers are utilized, one taper being in the approximate plane of the primary panel while the other taper is in the approximate plane of the secondary panel.

Referring to FIGS. 1 to 3 which illustrates the preferred embodiment of a primary panel 2 for use in this invention it can be seen that primary panel 2 incorporates a main body section 4. Opposite sides of primary panel 2 incorporate female apertures 3 and 5. For purposes of this description the left side of primary panel 2 will be described only, although it is understood and clearly illustrated that both the left and right side of primary panel 2 incorporate similar female apertures.

Female aperture 3 being defined by an L shaped projection 10 and a triangular projection 6. Triangular projection 6 is a right triangle having sides 22, 26 and 30.

For purposes of describing the relation of the various component parts of the primary and secondary panels the inner surface of said panels is defined as that surface which would face the center of the resulting pallet container. In describing the position of various tapered surfaces as are an integral part of the primary and secondary panels the terms inner and outer are used in relation to the vertical center line of said panels.

Triangular projection 6 further includes a tapered surface 34. Tapered surface 34 tapers outwardly from the center of primary panel 2 from top to bottom. That is female aperture 3 is widest at its upper extremity. The approximate plane of tapered surface 34 is at right angles to the plane of primary panel 2. The use of a triangular projection such as projection 6 to define a tapered surface is the preferred embodiment of this invention as a tapered surface of a large surface area results.

Female aperture 3 is defined on the outer edge of primary panel 2 by L shaped projection 10. The short leg of L shaped projection 10 comprises a tapered surface 35 which tapers in a plane approximately parallel to the plane of primary panel 2. Tapered surface 35 is narrowest at its bottom extremity and widest at its upper extremity.

From the above description and FIG. 1 it can be seen that both sides of primary panel 2 incorporate a pair of taper surfaces 34 and 36 which are at right angles to the plane of primary panel 2. Further both sides of primary panel 2 incorporate a pair of tapered surfaces 35 and 37 which are parallel to the plane of primary panel 2.

Female apertures 3 and 5 terminate on ledges 18 and 20 which may further act as stops for the secondary panel in a manner which will be described herein below.

Primary panel 2 further incorporates a pair of ground engaging legs 14 and 16 which define an aperture 15, which is adapted to receive a lifting means such as the arms of a fork lift truck. Legs 14 and 16 are not a necessary part of the pallet container of this invention, but are very useful if said pallet container is to be moved by a fork lift truck.

Figure 4:
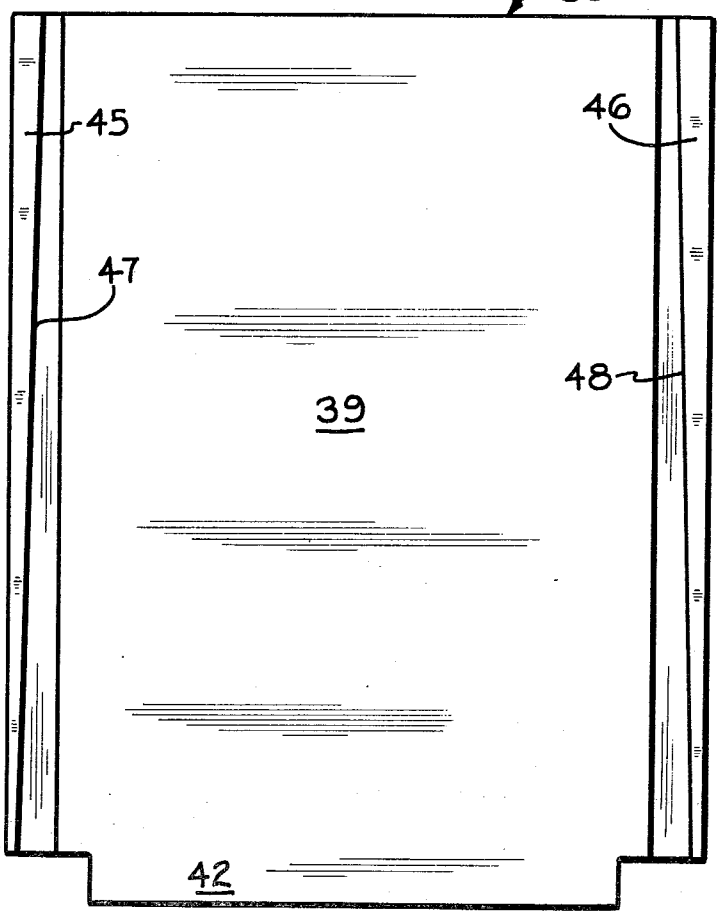
FIG. 4 is a back view of the secondary panel for use in this invention.
Figure 5:
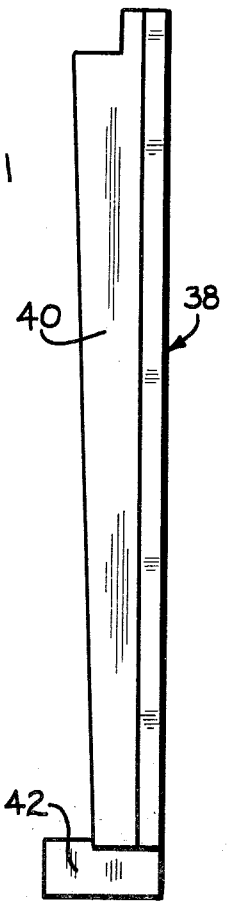
FIG. 5 is an end view of the secondary panel for use in this invention.
Figure 6:
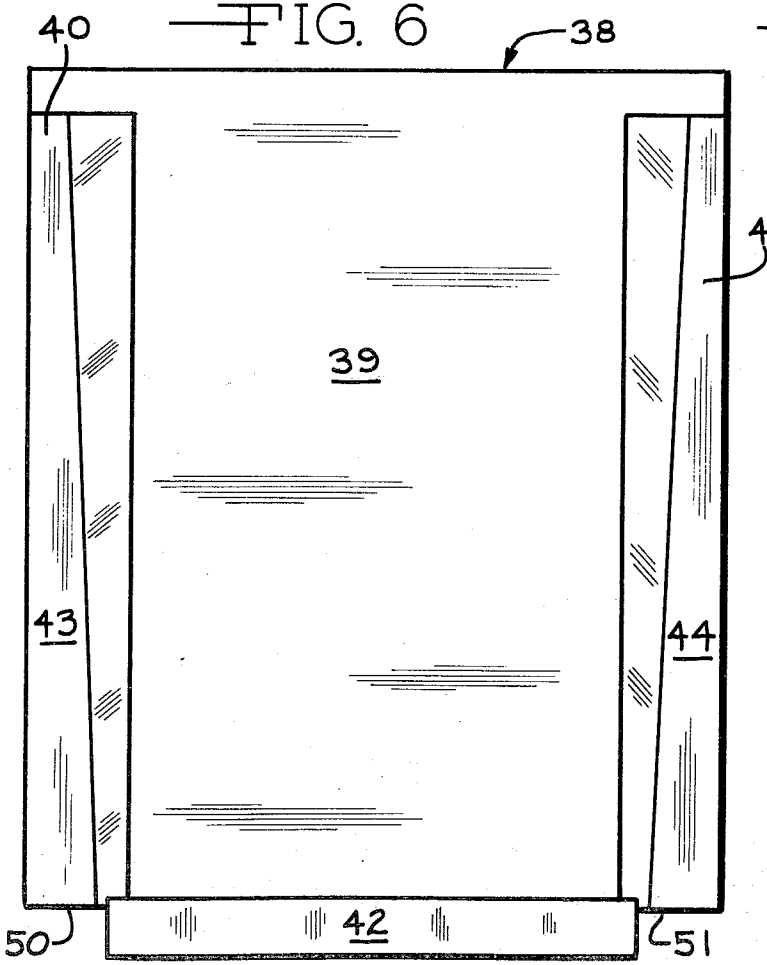
FIG. 6 is a front view of the secondary panel for use in this invention.

FIGS. 4 and 7 illustrate a preferred embodiment of a secondary panel for use in conjunction with the primary panel as described above with reference to FIGS. 1 to 3. Secondary panel 38 incorporates a pair of locking lugs 40 and 41 which are adapted to be received into and are complimentary to female apertures 3 and 5 as described above.

Secondary panel 38 further incorporates a ground engaging leg section 42. As was described above with reference to legs 14 and 16 of primary panel 2, leg section 42 is not a necessary part of this invention.

Locking legs 40 and 41 of secondary panel 38 further incorporate tapered surfaces 43 and 44. Tapers surface 43 and 44 which are approximately parallel with the plane of secondary panel 38 and at right angles to the plane of primary panel 2. Tapers 43 and 44 are complimentary to tapered surfaces 34 and 36 of primary panel 2.

Locking lugs 40 and 41 further incorporate an L shaped projections 45 and 46 having tapered surfaces 47 and 48 which are approximately at right angles to the plane of secondary panel 38 and parallel with the plane of primary panel 2. Tapered surfaces 47 and 48 are complimentary to tapered surfaces 35 and 37 of primary panel 2.

In describing the tapered surfaces on both the primary and secondary panels the terms approximately parallel and approximately at right angles to are utilized in describing said surfaces. It is understood by one skilled in the art that as a result of the slight tapers on said surfaces they are not in fact parallel to or at right angles to either the primary or secondary panels. Accordingly these tapered surfaces are described as being approximately parallel or approximately right angles to the planes of the respective primary or secondary panels.

Figure 12:
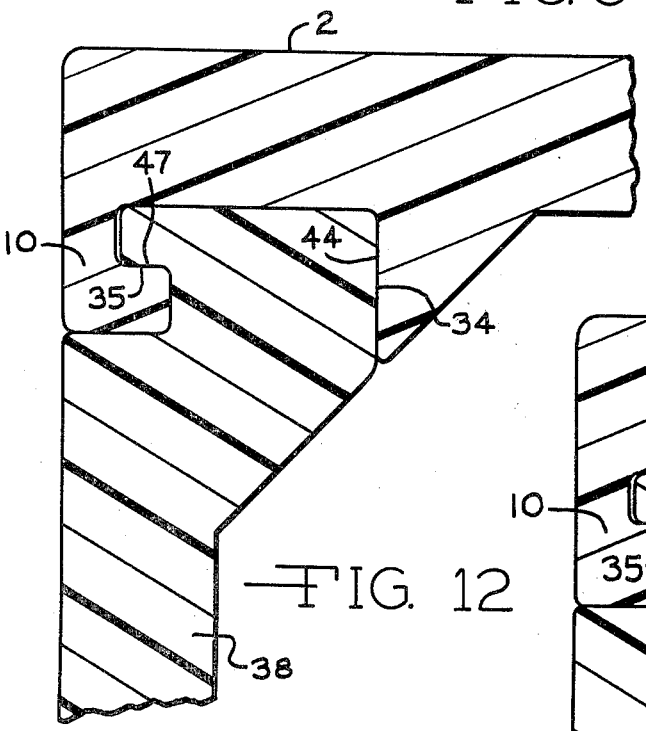
FIG. 12 is a section along line 12—12 of FIG. 10 showing the joining of a primary panel to a secondary panel.
Figure 13:
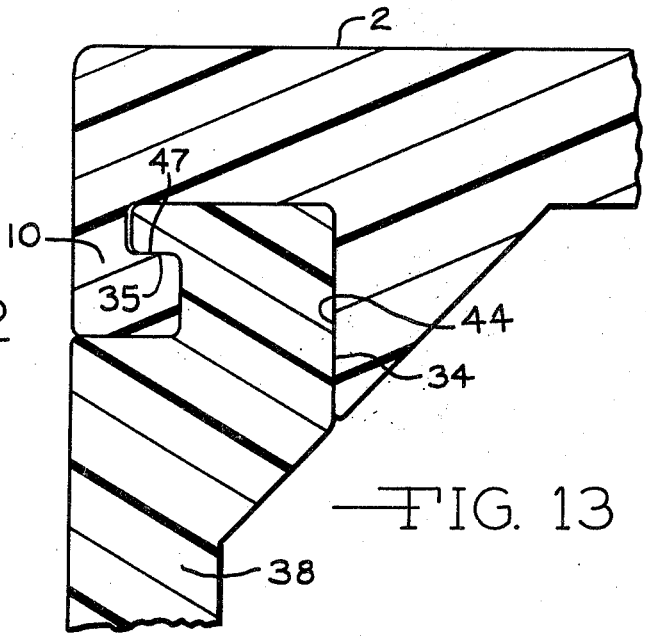
FIG. 13 is a section along line 13—13 of FIG. 10 showing the joining of a primary panel to a secondary panel.

Referring to FIGS. 12 and 13 the interlocking relationship of the various tapers on both the primary panel 2 and the secondary panel 38 can be seen. From these figures it can be seen that the cross section of L shaped projection 10 on primary panel 2, in a plane parallel with the plane of secondary panel 38, increases as the distance from the top of primary panel 2 increases. Further it can be seen that as a result of tapered surfaces 34 and 44 the cross section of locking lug 40, in a plane parallel with the plane of primary panel 2 decreases as the distance from the top of primary panel 2 increases.

It is preferred that tapered surfaces 34, 35, 44 and 47 be such that the vertical movement of secondary panel 38 with respect to primary panel 2 be terminated before flange 51 of secondary panel 39 engages surface 52 of primary panel 2. As a result of this configuration when a load is applied to the bottom side of primary panel 2, for example a fork lift truck the load is distributed over the total surface area of tapered surfaces 34, 35, 44 and 47, accordingly maximum structural integrity is achieved.

Figure 9:
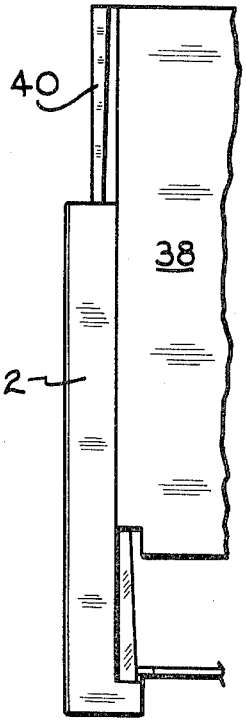
FIG. 9 illustrates the primary and secondary panels in a partially assembled stance.
Figure 8:
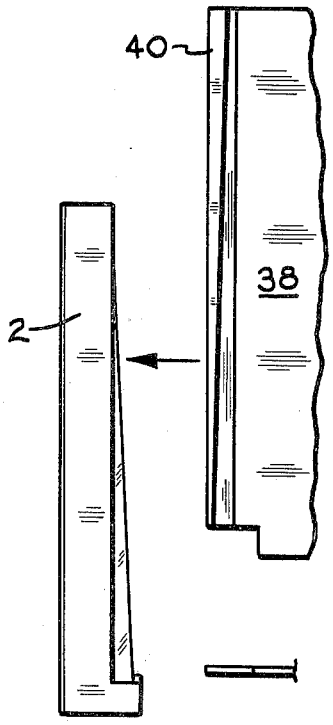
FIG. 8 illustrates the assembly of the primary and secondary panels.
Figure 10:
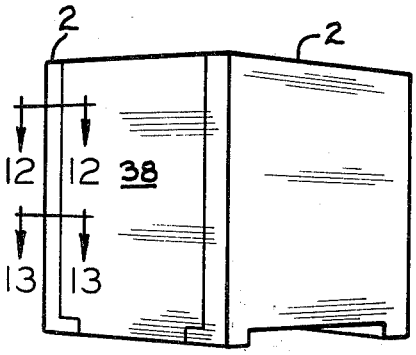
FIG. 10 is a perspective side view of a secondary panel wherein said secondary panel is joined to a pair of primary panels.

FIGS. 8 and 9 illustrate how a secondary panel 38 may be inserted into primary panel 2 by the lifting of secondary panel 38 approximately one half the height of primary panel 2. Because of the double taper means which is described in detail herein above locking lug 40 may be inserted into primary panel 2 at this height. Once this positioning is effected secondary panel 38 is lowered whereupon tapered surfaces 34, 35, 44 and 47 engage each other thereby securing primary panel 2 and secondary panel 38 together. Once these panels are secured together the only possible mode of movement is to lift secondary panel 38 up to a point where it can be withdrawn from primary panel 2.

Figure 11:
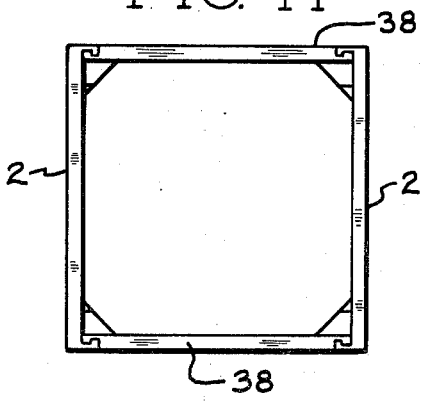
FIG. 11 is a top plan view showing a pair of primary panels which are joined by a pair of secondary panels.

When a pair of primary panels 2 are joined with a pair of secondary panels 38 as is illustrated in FIG. 11 a very strong and rigid container results. It is understood that while a square container is illustrated in FIG. 11 a retangular container of any convenient dimensions could likewise be formed.

Figure 14:
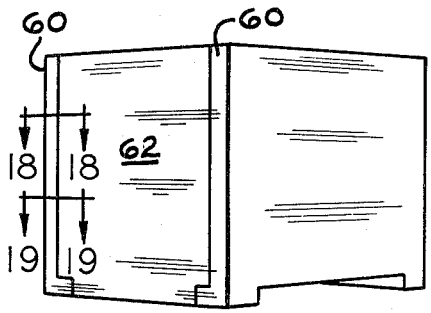
FIG. 14 is a perspective side view of another embodiment of this invention using a conical taper where said secondary panel is joined to a pair of primary panels.
Figure 19:
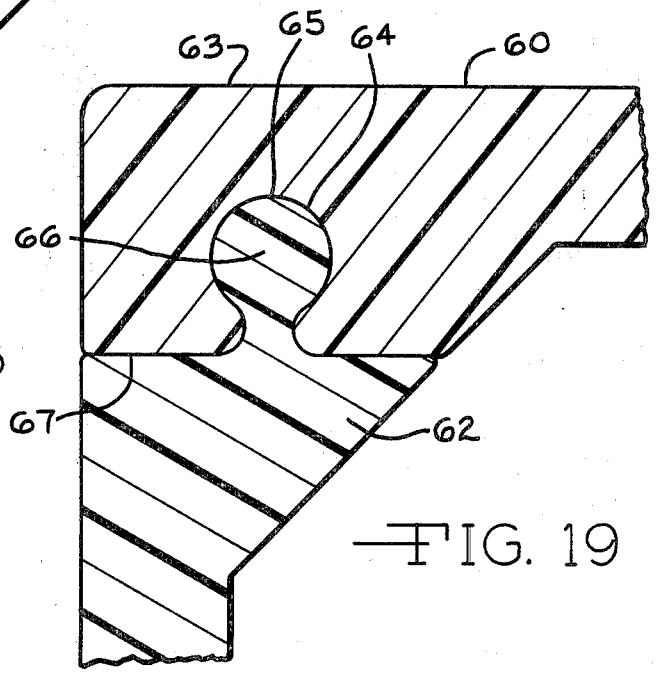
FIG. 19 is a section along line 19—19 of FIG. 14 showing the joining of a primary panel to a secondary panel.

Another embodiment of this invention is illustrated in FIGS. 14 and 19 where primary panel 60 incorporates a female conical tapered aperture 64 which is largest at its upper extremity. Secondary panel 62 incorporates a complimentary male conical projection 66. Male tapered conical projection 66 is adapted to be received in complimentary female tapered aperture 64. Because of the taper in both aperture 64 and projection 66 secondary panel 62 need only be raised approximately one half the height of primary panel 60 during assembly. The use of conical surfaces such as aperture 64 and projection 66 is desirable as the conical nature of said surfaces provides a large surface for high strength. In this embodiment the opposing sides of the conical surfaces function as opposing tapers.

Figure 18:
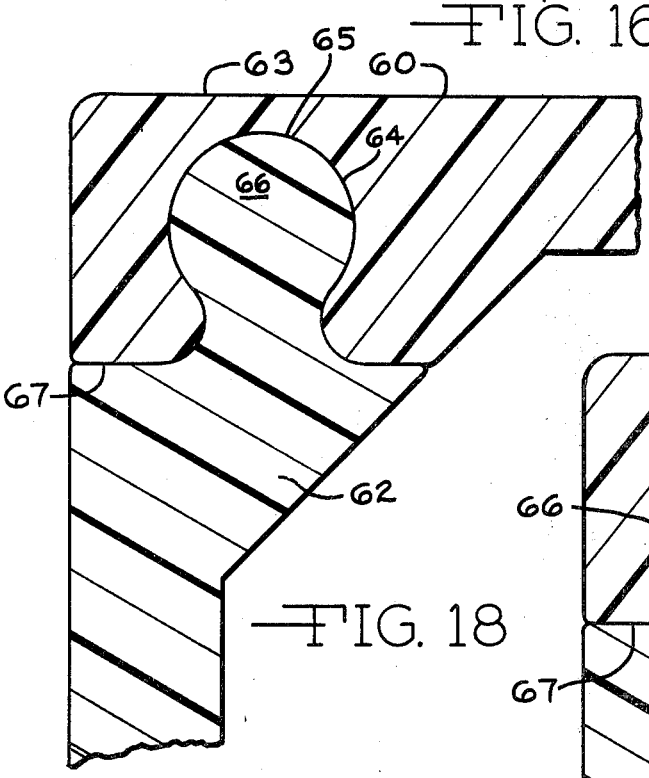
FIG. 18 is a section along line 18—18 of FIG. 14 showing the joining of a primary panel to a secondary panel.

In the structure as is illustrated in FIGS. 18 and 19 the axis of conical projection 66 on secondary panel 62 and hence female tapered aperture 64 are angularly disposed relative to the plane of primary panel 60. This can be seen by a comparison of FIG. 18 with FIG. 19 wherein surface 65 increases in distance from side 63 of primary panel 60 as the distance from the top surface 61 of primary panel 60 increases.

Figure 17:
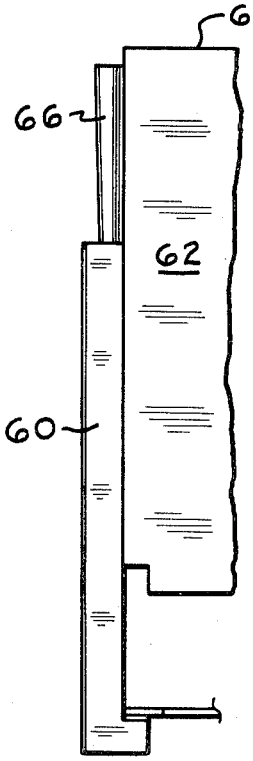
FIGS. 16 and 17 illustrate the assembly of the primary and secondary panels of that embodiment of this invention which utilizes a conical taper.
Figure 16:
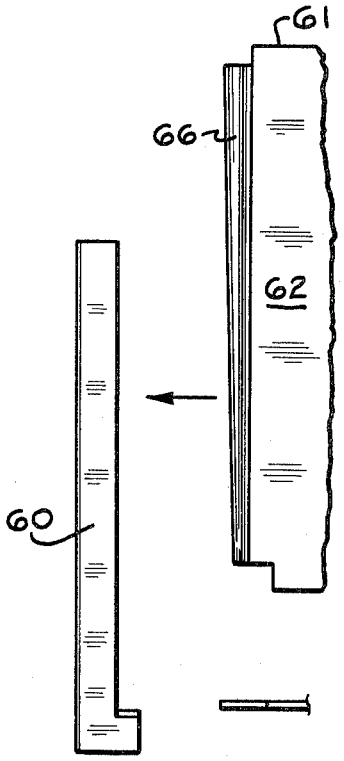

From an examination of FIGS. 16 and 17 it can be seen that during assembly secondary panel 62 need only be raised approximately one half the height of primary panel 60 before projection 66 can be placed in female tapered aperture 64. Once this placement occurs secondary panel 62 need only be lowered to lock said secondary panel in relationship with primary panel 60.

Figure 15:
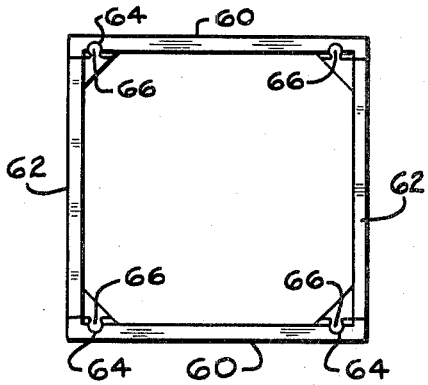
FIG. 15 is a top plan view of another embodiment of this invention using a conical taper showing a pair of primary panels which are joined by a pair of secondary panels.

FIG. 15 further illustrates that when a pair of primary panels 60 are locked into relationship with a pair of secondary panels a four sided container is formed.

Figure 28:
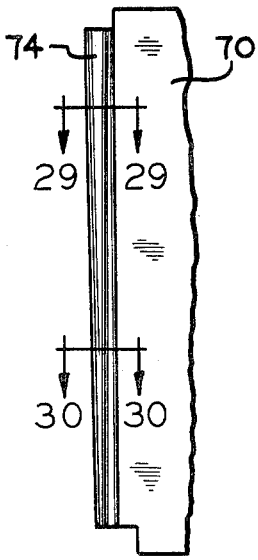
FIG. 28 is a side view of an end section of another embodiment of a secondary panel for use in this invention.
Figure 29:
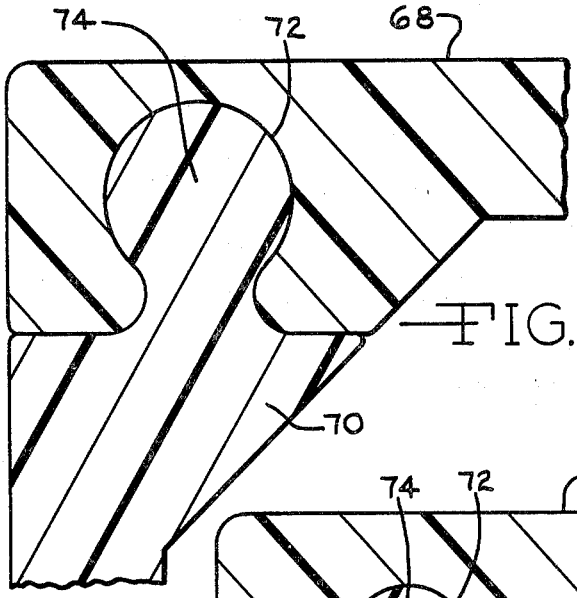
FIG. 29 is a section along line 29—29 of FIG. 28 showing the joining of a primary panel to a secondary panel.
Figure 30:
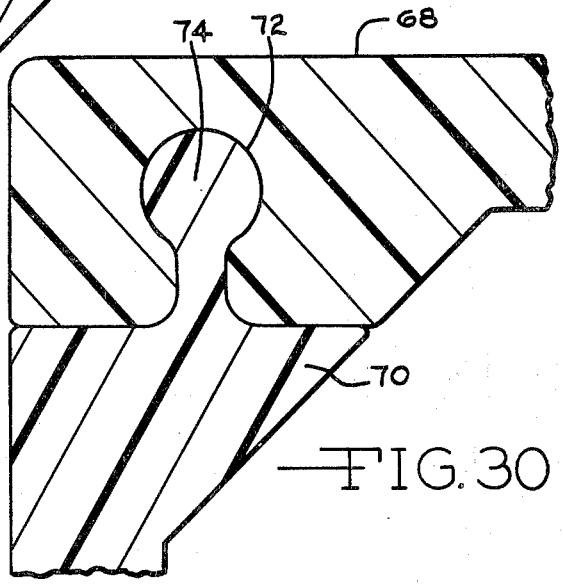
FIG. 30 is a section along line 30—30 of FIG. 28 showing the joining of a primary panel to a secondary panel.

FIGS. 28, 29 and 30 illustrate another embodiment of this invention wherein a conical attachment means is utilized. In this embodiment primary panel 68 is adapted to receive a secondary panel 70. Primary panel 68 incorporates a female tapered aperture 72. Secondary panel 70 incorporates a complimentary tapered projection 74. In this embodiment the axis of tapered projection 74 and hence the axis of female tapered aperture 72 are parallel with plane of primary panel 68.

Because of the tapered nature of projection 74 and female tapered aperture 72 the assembly of secondary panel 72 into primary panel 70 can be effected in a manner similar to that described above with reference to FIG. 15.

The structure as is illustrated in FIGS. 18 and 19 as compared to the structure FIGS. 29 and 30 is a preferred version as the locking means has a shorter distance to surface 67 and therefore is less likely to be distorted by creep when a load is applied to the resulting composite container.

In still another embodiment of this invention as is illustrated in FIGS. 20 to 25 primary panel 76 incorporates a wedge shaped female slot 80 having a pair of opposing dovetail surfaces 82 and 84. Secondary panel 78 incorporates a complimentary male wedge shaped projection 86 which incorporates a pair of opposing dovetail surfaces 88 and 90, wedge shaped female slot 80 is complimentary to male projection 86. As a result of opposing dovetail surfaces 82, 84, 88 and 90 angularly disposed locking forces are achieved.

As was mentioned above the fastening means of this embodiment incorporates a pair of complimentary dovetail surfaces. The third primary surface of wedge shaped projection 86 side 94 and complimentary surface 96 of wedge shaped female slot 80 is also tapered as can be seen from an examination of FIGS. 24 and 25 wherein it can be seen that as the length of wedge shaped projection 86 increases from the top surface 98 of secondary panel 78 all sides of wedge shaped projection 86 decrease in size. This arrangement provides for a maximum locking ability once a pair or primary panels are joined together with a pair of secondary panels in accordance with the teaching of FIG. 21.

Figure 23:
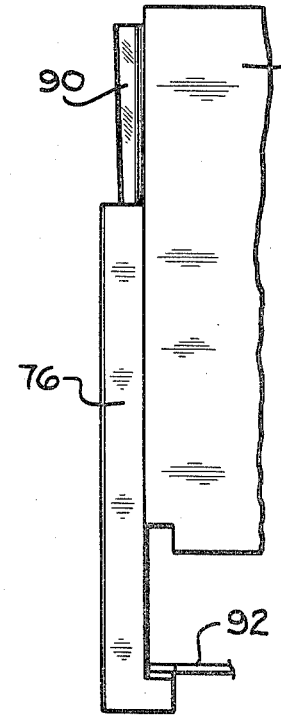
FIGS. 22 and 23 illustrate the assembly of the primary and secondary panels of that embodiment of this invention which utilizes a wedge shaped taper.
Figure 22:
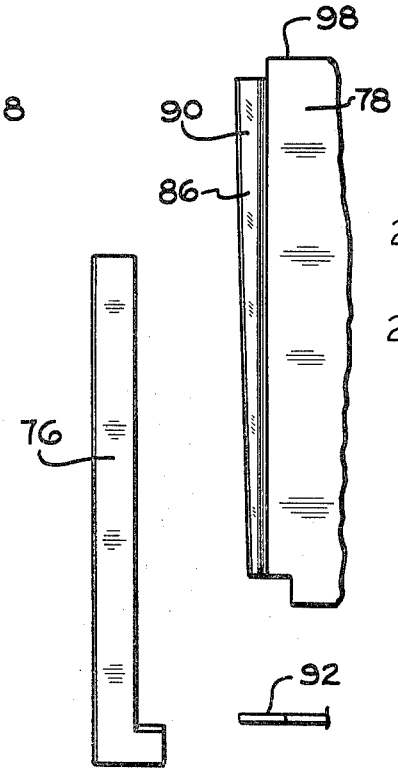
Figure 20:
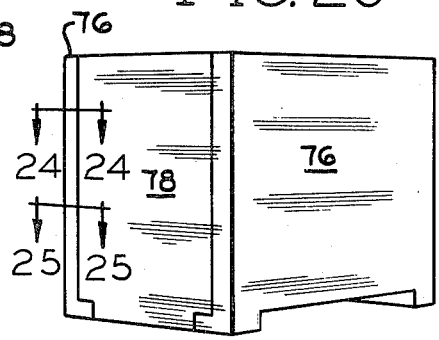
FIG. 20 is a perspective side view of another embodiment of this invention using a wedge shaped taper where said secondary panel is joined to a pair of primary panels.
Figure 21:
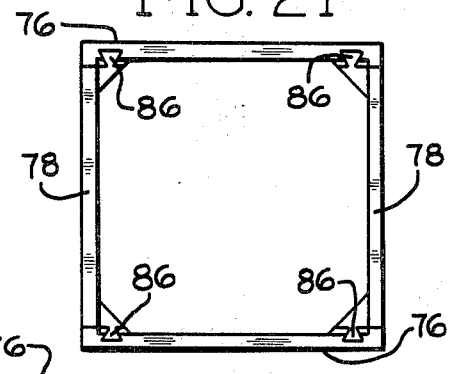
FIG. 21 is a top plan view of another embodiment of this invention using a wedge shaped taper showing a pair of primary panels which are joined by a pair of secondary panels.
Figure 24:
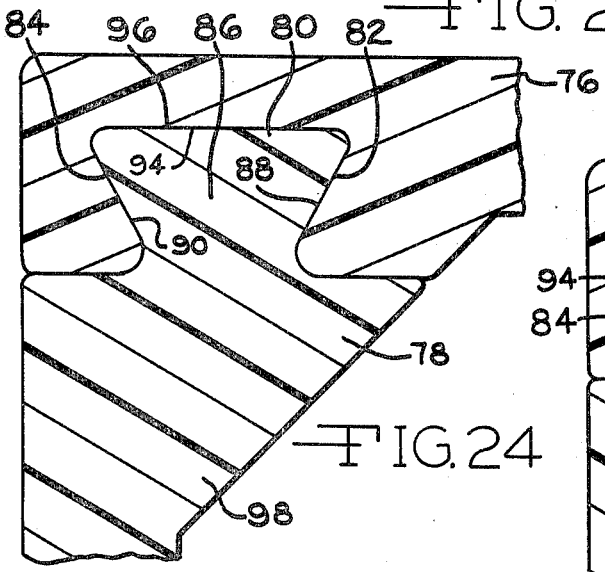
FIG. 24 is a section along line 24—24 of FIG. 20 showing the joining of a primary panel to a secondary panel.
Figure 25:
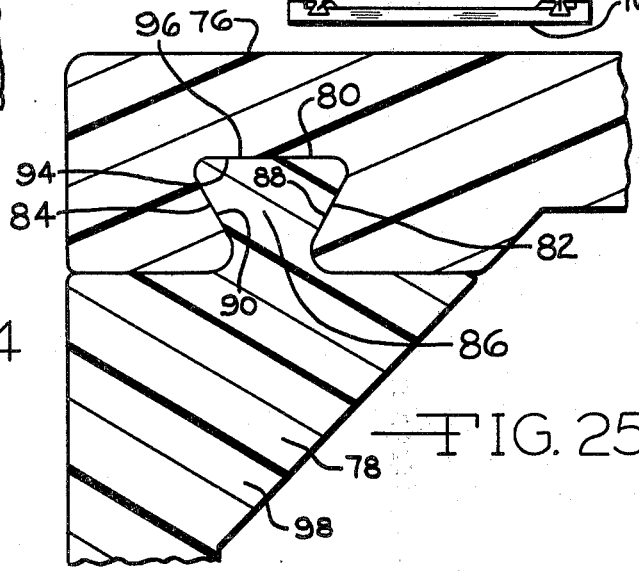
FIG. 25 is a section along 25—25 of FIG. 20 showing the joining of a primary panel to a secondary panel.

From an examination of FIGS. 22 and 23 it can be seen that as a result of wedge shaped projection 86 and wedge shaped female slot 80, secondary panel 78 can be placed in a locking position with primary panel 76 when secondary panel 78 is raised approximately one half the height of primary panel 76.

These figures further illustrate a suitable bottom means 92. It can be seen that wedge shaped projection 86 is supported on a triangular support 98. If desired triangular support 98 can be eliminated with wedge shaped projection 86 being formed as an integral part of the end of secondary panel 78.

Figure 31:
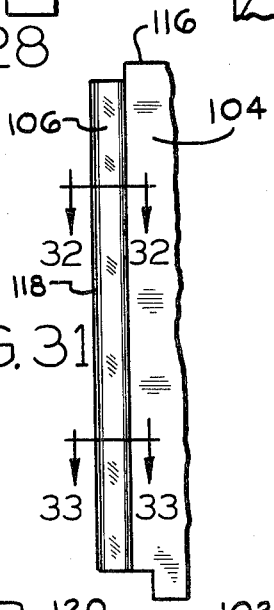
FIG. 31 is a side view of an end section of another embodiment of a secondary panel for use in this invention.
Figure 32:
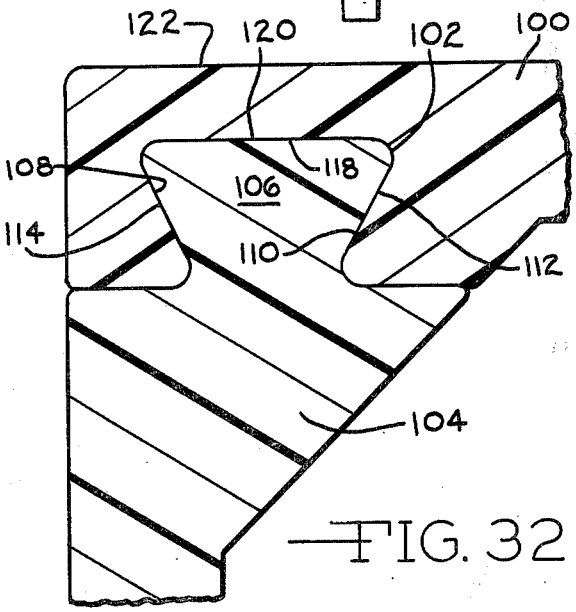
FIG. 32 is a section along line 32—32 of FIG. 31 showing the joining of a primary panel to a secondary panel.
Figure 33:
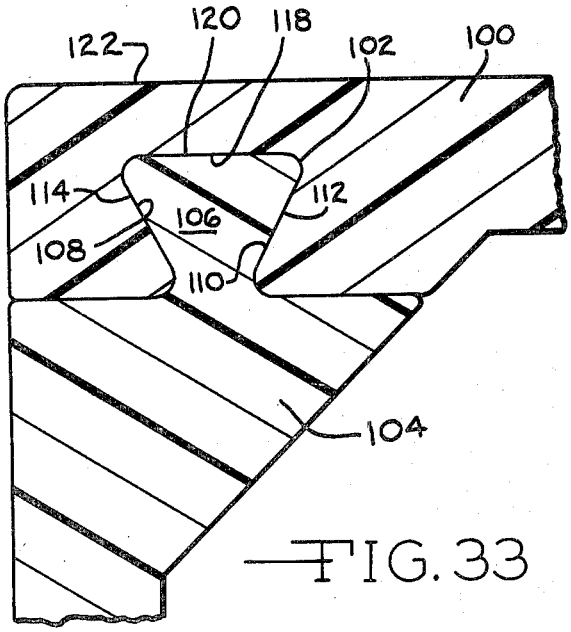
FIG. 33 is a section along line 33—33 of FIG. 31 showing the joining of a primary panel to a secondary panel.

Another aspect of this invention is illustrated in FIGS. 31 to 33 wherein a wedge shaped locking means is utilized. In this embodiment primary panel 100 incorporates a wedge shaped female slot 102 which is adapted to receive a complimentary wedge shaped projection 106 which is an integral part of secondary panel 104. Sides 108 and 110 of wedge shaped projection 106 and sides 112 and 114 of wedge shaped female slot 102 are tapered. As the length of wedge shaped projection 106 increases from the top surface 116 of secondary panel 104 the size of wedge shaped projection 106 decreases. Side 118 of wedge shaped projection 106 is not tapered and hence is parallel with edge 122 of primary panel 100. Surface 120 of wedge shaped female aperture 102 is complimentary to side 118 of wedge shaped projection 106.

It can be seen that the principle difference as compared to the embodiment illustrated in FIGS. 31 to 33 is that the outermost surface of the wedge shaped fastening means is tapered in the former and not tapered in the latter. Again as a result of the opposing tapered surfaces as described above an angularly disposed locking force is achieved.

Figure 26:
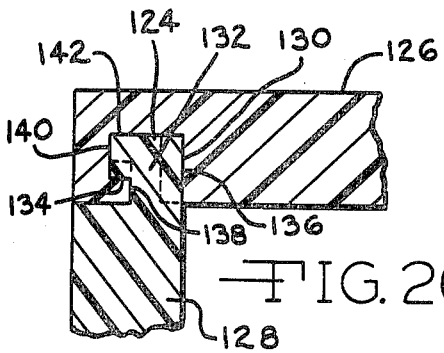
FIGS. 26 and 27 illustrate still another embodiment of this invention wherein a primary panel is attached to a secondary panel by an L shaped taper locking means.
Figure 27:
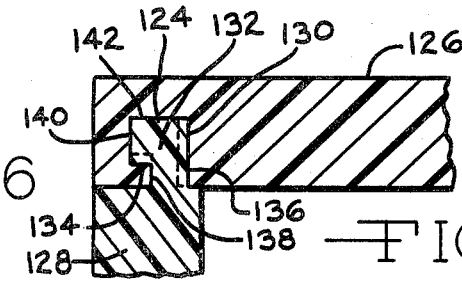

FIGS. 26 and 27 illustrate still another embodiment of this invention wherein an L shaped tapered locking means 124 is utilized, wherein said locking means 124 incorporates at least two complimentary tapered surfaces. In this embodiment primary panel 126 incorporates a female L shaped tapered aperture 130. The end of secondary panel 128 is formed into a complimentary L shaped tapered member 132. It can be seen that tapered member 132 is adapted to fit into tapered aperture 130. At least two surfaces on the locking means 124 which comprises L shaped tapered aperture 130 and taper member 132 must incorporate tapers.

It is preferred that tapers be incorporated on surfaces 134 and 136 of locking means 124. Tapered surface 134 is approximately parallel with the plane of primary panel 126. Tapered surface 136 is approximately at right angles to the plane of primary panel 126.

In still another aspect of this embodiment surfaces 134 and 138 of locking means 124 are tapered with surface 140 being non bearing.

Finally in another aspect surfaces 134 and 138 and 140 of locking means 124 are tapered with all surfaces being load bearing.

It is understood by one skilled in the art that while various surfaces are described as being tapered above the other remaining surfaces on locking means 124 may likewise be tapered with the exception of that embodiment described above where surface 140 is non bearing.

With reference to the preferred aspect of this embodiment as described above wherein surfaces 134 and 136 of locking means 124 are tapered it can be seen that surface 136 comprises the largest outside leg of L shaped tapered member 132 this surface being parallel with the plane of secondary panel 128. Surface 134 is the shortest inside leg of locking means 124, surface 134 being parallel with the plane primary panel 126. When using an L shaped locking means such as locking means 124 in this invention it is imperative that at least one tapered surface on the L shaped tapered member be in the plane of the primary panel and at least one tapered surface be in the plane of the secondary panel.

It is understood that the pallet container of this invention may be formed from any convenient material such as wood, rubber or metal. However, it is preferred that the component parts of this invention be formed from a polymeric material. It is preferred that the component parts of this invention be formed from polymeric materials which are adapted to injection molding techniques. Examples of suitable polymeric materials from which the component parts of the pallet container of this invention may be formed are filled and unfilled, reinforced and unreinforced polymeric materials such as polyethylene, polypropylene, polystyrene, nylon, polyvinylchloride etc.

The primary and secondary panels as described above and the integral bottom section if used may incorporate a plurality of perforations and ribs. These perforations and ribs function to strengthen and minimize the weight of the component parts. It is understood by one skilled in the art that these perforations and ribs may be formed as a integral part of the component parts during injection molding.

Further, during the molding operation the component parts such as the bottom section, primary panels and secondary panels may be provided with a plurality of apertures which index with complimentary apertures in opposing components. The resulting composite pallet container may be permanently secured together by passing and securing suitable fasteners such as bolts or screws through said apertures so as to secure said component parts in position.

As is described above in detail the composite pallet container of this invention is adapted to utilize a specially molded bottom section. It is understood however that said molded bottom section is not a necessary or integral part of this invention. The composite pallet container of this invention may utilize any convenient type of bottom section such as properly cut sheets of wood, rubber, metal or polymeric materials. Further the composite pallet container of this invention can be attached to a standard pallet base.

The tapers as are an integral part of the tapered surfaces on the primary and secondary panel can be of any suitable degree. In accordance with the preferred aspect of this invention these tapers are in range of one to two degrees.

When a lifting force is applied to the composite pallet container the forces on the overall pallet container are at maximum. These forces are exerted in all planes, for example when a fork lift truck lifts the pallet container of this invention which is loaded with produce. The composite pallet container of this invention is particularly advantageous in this regard as when the maximum forces are exerted the maximum structural integrity of the composite pallet container is achieved. Further with this locking arrangement when a lifting force is applied the load is evenly distributed to all four walls of said pallet container.

In the above discussed drawings relative to the various embodiment of this invention specific proportions and dimensions are shown. It is understood that these proportions and dimensions can be varied accordingly. The above description and drawings are illustrated only. The scope of the present invention is to be limited only by the following claims.

What is claimed is:

1. A composite pallet container comprising a pair of primary panels to which are joined a pair of secondary panels, each of said primary panels and secondary panels having a pair of opposing complimentary locking means on their outermost vertical edges; the locking means on the primary panel comprising locking apertures which are largest at their upper extremities, said locking apertures being defined by at least two opposing tapered surfaces at least one of which is in the approximate plane of the primary panel and at least one of which is in the approximate plane of the secondary panel; the locking means on the secondary panel comprising a pair of projections which are largest at their upper extremities said projections having opposing tapered surfaces at least one of which is in the approximate plane of the primary panel and at least one of which is in the approximate plane of the secondary panel.

2. The composite pallet container of claim 1 wherein the locking apertures on the primary panel are defined by an inner tapered surface which is in the approximate plane of the secondary panel and an outer tapered surface which is in the approximate plane of the primary panel and the projections on the secondary panel are complimentary to said locking apertures.

3. The composite pallet container of claim 1 wherein the locking apertures on the primary panel are defined by an inner tapered surface which is in the approximate plane of the primary panel and an outer tapered surface which is in the approximate plane of the secondary panel and the projections on the secondary panel are complimentary to said locking apertures.

4. The composite pallet container of claim 1 wherein the locking apertures on the primary panel are defined by inner tapered surfaces which are in the approximate plane of the secondary panel and an outer tapered surfaces which are in the approximate plane of the primary panel and the projections on the secondary panel have inner tapered surfaces which are in the approximate plane of the secondary panel and outer tapered surfaces which are in the approximate plane of the secondary panel.

5. The composite pallet container of claim 1 wherein the locking apertures of said primary panel are defined by L shaped projections and spaced apart triangular projections wherein at least one leg of each of said L shaped projections comprises a tapered surface and at least one side of each of said triangular projections comprises a tapered surface wherein said tapered surface are angularly disposed to each other.

6. The composite pallet container of claim 5 wherein said L shaped projections are positioned on the outermost vertical edges of said primary panel and wherein said triangular projections are spaced inwardly apart from said L shaped projections, wherein the surfaces of said triangular projections which are adjacent to the outer most vertical edges of said primary panel, in the approximate plane of the secondary panel, are tapered and wherein the inner surfaces of the short legs of the L shaped projections, in the approximate plane of the primary panel are tapered.

7. A composite pallet container comprising a pair of primary panels to which are joined a pair of secondary panels, each of said primary panels having a pair of L shaped locking apertures disposed on its vertical edges wherein at least two surfaces of said L shaped locking apertures are tapered, said tapered surfaces being angularly disposed to each other, and wherein the vertical end edges of said secondary panels incorporate L shaped projections which are complimentary to said L shaped locking apertures.

8. The composite pallet container of claim 7 wherein the longest surface of said L shaped locking aperture, in a plane approximately parallel with the plane of said secondary panel is tapered and wherein the shortest surface of said L shaped locking aperture in a plane approximately parallel with said primary panel is tapered.

9. A composite pallet container comprising a pair of primary panels to which are joined a pair of secondary panels, each of said primary panels having a pair of conical shaped locking apertures disposed on its vertical edges, and wherein the vertical ends of said secondary panels incorporate conical shaped projections which are complimentary to said conical shaped locking apertures.

10. The composite pallet container of claim 9 wherein the axis of said conical shaped locking apertures are parallel with the plane of said primary panel.

11. The composite pallet container of claim 9 wherein the axis of said conical shaped locking apertures are angularly disposed relative to the plane of said primary panel.

12. A composite pallet container comprising a pair of primary panels to which are joined a pair of secondary panels, each of said primary panels having a pair of wedge shaped looking apertures disposed on its vertical edges, said wedge shaped locking aperture having a primary surface and a pair of opposing dovetail surfaces, and wherein the vertical ends of said secondary panels incorporate wedge shaped projections which are complimentary to said wedge shaped locking apertures.

13. The composite pallet container of claim 12 wherein the plane of the primary surface of the wedge shaped locking aperture is parallel with the plane of the primary panel.

14. The composite pallet container of claim 12 wherein the plane of the primary surface of the wedge shaped locking aperture is angularly disposed to the plane of the primary panel.

* * * * *